US005605614A

United States Patent [19]

Bornand

[11] Patent Number: 5,605,614

[45] Date of Patent: Feb. 25, 1997

[54] MAGNETIC MICROCONTACTOR AND MANUFACTURING METHOD THEREOF

[75] Inventor: Etienne Bornand, Boudry, Switzerland

[73] Assignee: Asulab S.A., Bienne, Switzerland

[21] Appl. No.: 490,546

[22] Filed: Jun. 14, 1995

[30] Foreign Application Priority Data

Jun. 17, 1994 [FR] France ..... 94 07468

[51] Int. Cl.[6] ..... C25D 7/00

[52] U.S. Cl. ..... 205/50; 205/90; 205/122

[58] Field of Search ..... 205/122, 90, 178; 335/38, 154

[56] References Cited

U.S. PATENT DOCUMENTS

| | | | |
|---|---|---|---|
| 3,974,468 | 8/1976 | Ygfors | 335/151 |
| 4,436,766 | 3/1984 | Williams | 427/96 |
| 4,899,439 | 12/1990 | Potter et al. | 29/846 |
| 4,920,639 | 5/1990 | Yee | 29/846 |

FOREIGN PATENT DOCUMENTS

| | | |
|---|---|---|
| 0459665 | 4/1991 | European Pat. Off. . |
| 602538 | 6/1994 | European Pat. Off. . |
| 2349962 | 11/1977 | France . |
| 248454 | 4/1986 | Germany . |

OTHER PUBLICATIONS

Physikalische Blatter, vol, 49, No. 3, Mar. 1993 Weinheim DE, pp. 179–184, Bley et al, "Aufbruch in die Mikrowelt" p. 181.

*Primary Examiner*—Kathryn Gorgos
*Assistant Examiner*—Brendan Mee
*Attorney, Agent, or Firm*—Griffin, Butler, Whisenhunt & Kurtossy

[57] ABSTRACT

Microcontactor able to be activated by a magnet comprising a flexible beam (5) in one or more conducting materials (13, 14, 15), having one end (4) attached to an insulating substrate (1) via the intermediary of a foot (3), and one free distal end (6) positioned above a contact stud (2) arranged on said substrate (1), said foot (3) and stud (2) being composed of conducting materials and provided with connecting means (7, 8, 9, 10) to an external electronic circuit, and said beam (5) being at least partly composed of a ferromagnetic material in which the beam (5), the foot (3) and the stud (2) are elements formed by electrodeposition of conducting materials from two areas (9, 10) of the substrate, said electrodeposition being carried out through a succession of masks (20, 30, 40) which are subsequently removed.

7 Claims, 3 Drawing Sheets

MAGNETIC MICROCONTACTOR AND MANUFACTURING METHOD THEREOF

FIELD OF THE INVENTION

The present invention concerns a magnetic microcontactor, that is to say an electrical contactor having dimensions in the magnitude order of a few tens of microns, comprising a flexible beam maintained above a substrate provided with a contact stud, said beam being at least partially made of a ferromagnetic material capable of being attracted by a magnet, so as to open or close an electrical contact.

The invention also concerns a manufacturing method which enables said microcontactor to be obtained by electrodeposition of the various conducting materials of which it is composed.

BACKGROUND OF THE INVENTION

Devices enabling an electrical circuit to be opened or closed under the influence of a magnetic field created by the approach of a magnet have been known for a long time and, following a natural evolution, the improvements made to the basis principle have concerned not only the construction of such devices but also their miniaturisation.

As regards construction, one of the devices disclosed in U.S. Pat. No. 3,974,468 can be cited, in which a non-ferromagnetic flexible conducting strip is bent, then fixed onto a support carrying the contact stud, the portion of said strip facing the support being partially covered with a ferromagnetic material capable of being attracted by a magnet to close the contact. While the dimensions of the strip may be reduced, it is not possible to envisage producing a mechanical assembly of parts having dimensions in the magnitude order of a few tens of microns.

As regards miniaturisation, micro-machining techniques, and in particular silicon wafer etching techniques, have enabled structures of very small dimensions to be obtained. For example, patent DD 248 454 discloses a magnetic contactor whose base and elastic strip are formed by etching of a silicon plate, the parts required to be conductors or ferromagnetic, being then electrodeposited. As can be seen, this method of construction has the disadvantage of requiring a succession of steps involving techniques of different types.

Structures comprising superposed conducting strips of very small dimensions may also be obtained by successive electrodeposition steps through masks, essentially for the purpose of creating interconnection plates for electronic circuits. For example, patent EP 0 459 665 discloses a device of the preceding type, in which the masks are preserved in the final product. In U.S. Pat. No. 4,899,439 on the other hand, it is proposed to eliminate the masks to obtain a tridimensional hollow rigid structure. However, in the two above examples, if the adhesive layers are disregarded, one will observe that the whole electrodeposition process is conducted with a single material, from which only conducting properties are expected, without the additional ferromagnetic properties enabling a new application to be envisaged. One will also observe that the strips or beams of structures thus obtained have no exploitable mechanical properties, in particular no flexibility.

However, contrary to this state of the art which has just been described above, the applicant has already produced a microcontactor of the "reed" type, having dimensions in the magnitude order of a few tens of microns, by jointly using materials possessing flexible and ferromagnetic properties. One "reed" microcontactor of this type is the object of patent application EP 0 602 538, which is the equivalent of U.S. Pat. No. 5,430,421 to Bornand which is incorporated by reference into the present application. The device which is disclosed is obtained by electrodeposition of a conducting material and a ferromagnetic material through masks, so as to obtain two ferromagnetic beams facing each other and separated by a space, at least one of the beams being flexible and connected to the support by a foot. Although providing complete satisfaction, a device of this type has the usual disadvantages of reed contactors, namely use requiring a very accurate positioning of the generator of the magnetic flow, and too great a sensitivity to the disturbances capable of being induced by the proximity of other ferromagnetic parts.

SUMMARY OF THE INVENTION

An aim of the present invention is thus to provide a magnetic microcontactor enabling these disadvantages to be overcome, whereby the positioning of a magnet in order to activate it does not require such a great precision, and whereby its operation is not influenced by the proximity of other ferromagnetic parts. As will be seen in the following description, the microcontactor according to the invention also provides the advantage of having an even smaller thickness than that of the device disclosed in patent EP 0 602 538, and of being able to be produced at a lower cost, by reason of the smaller number of steps necessary to make it.

Another aim of the invention is thus to provide a manufacturing method enabling a magnetic microcontactor having dimensions in the magnitude order of a few tens of microns to be obtained in an advantageous manner, which usual machining techniques or even micro-machining techniques do not allow.

For convenience, the magnetic microcontactor according to the invention will be designated henceforth "MMC contactor".

Thus the invention concerns a MMC contactor comprising a flexible beam made of one or more conducting materials, one end of which is attached to a substrate via the intermediary of a foot, and whose distal part is disposed above a contact stud arranged on said substrate, said foot and stud being formed of conducting materials and at least one part of said beam comprising a ferromagnetic material capable of being activated by a magnet, enabling the distal part of the beam to move towards or away from the contact stud to establish or break an electrical contact.

Another aim of the present invention is to provide a method of manufacturing by electrodeposition a magnetic microcontactor of the preceding type, comprising the successive steps of:

a) forming two separate conducting areas on an insulating substrate;

b) forming a first mask by depositing of a layer of photoresist and configuring the latter, so as to form at least two windows each disposed above a conducting area, and in the vicinity of their facing edges;

c) growing by electrodeposition a metal in order to create studs in the windows until the metal is flush with the photoresist surface;

d) forming a second mask by depositing a layer of photoresist and configuring over its entire thickness of a window above a single stud, said window having a low aspect ratio, that is to say having tapered walls;

e) growing by electrodeposition an intermediate metallization layer over the entire surface of the photoresist layer, walls and the bottom of the window formed in step d);

f) forming a third mask by depositing of a thick layer of photoresist and configuring over its entire thickness of a channel extending between the farthest edges of the studs situated close to the edges facing the conducting areas of the substrate;

g) growing by electrodeposition a ferromagnetic material, to form the beam, this step being possibly preceded by the electrodeposition of a small thickness of a non magnetic material intended to improve the contact;

h) growing by electrodeposition of a compressive material;

i) removing, in one or more steps, of the photoresist layers and the intermediate metallization layer chemically and mechanically, or solely chemically.

The masks through which the electrodeposition is carried out are obtained by known methods, consisting of configuring a layer of photoresist, designated by the general term "photoresist", so as to arrange windows in its thickness in the desired places.

According to the types of photoresist used, and according to the operating conditions used, it is possible to modify the aspect of the windows produced. Generally, by following the optimum conditions recommended by the photoresist manufacturer, one obtains windows with a high aspect ratio, that is to say with substantially vertical walls. On the other hand, by moving away from the optimum recommendations one obtains windows with a low aspect ratio, that is to say with tapered walls.

The ferromagnetic material used in step g) for the electrodeposition of the beam is for example a iron-nickel alloy in a proportion of 20/80 respectively.

In step h) the compressive material used is for example chromium. Equally step h) could be omitted and replaced by a step h') which would preceed step g) and consist of carrying out a electrodeposition of a tensile metal. The material used for improving of the contact is for example gold. Likewise, although the foot and the studs may be made of any metal, gold is preferably used for this electrodeposition step.

Thus, by carrying out steps a) to g) and i) of the method which has just been described, one obtains a MMC contactor in which the distal end of the beam and the contact stud are separated by a free space. This corresponds to a first implementation mode enabling a MMC contactor which is normally open in the absence of a magnetic field to be obtained.

On the other hand, by carrying out steps a) to i) of the method, one obtains a MMC contactor in which the forced bending of the beam establishes a contact between its distal end and the contact stud in the absence of a magnetic field. This corresponds to a second implementation mode enabling a MMC contactor which is normally closed to be obtained.

BRIEF DESCRIPTION OF THE DRAWINGS

The features and advantages of the invention will be better understood upon reading the detailed description which follows, given solely by way of example, and made with reference to the drawings in which.

DESCRIPTION OF THE PREFERRED EMBODIMENTS

Figure 1:
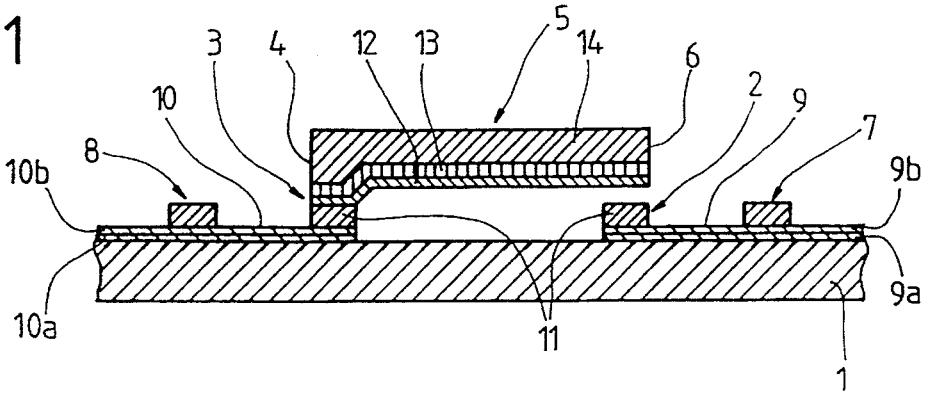
FIG. 1 is a side view in cross-section of a MMC contactor according to a first embodiment of the invention.
Figure 2:
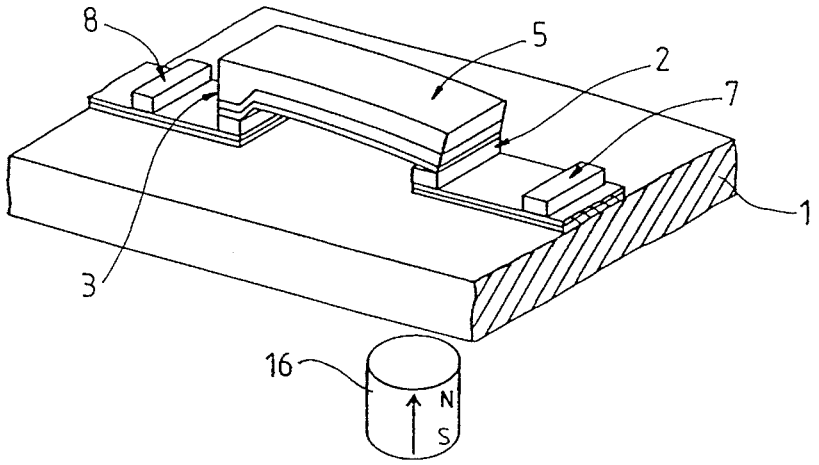
FIG. 2 is a simplified perspective view of the MMC contactor according to the first embodiment, when it is activated by a magnet.

FIGS. 1 and 2 show a MMC contactor according to a first embodiment. It comprises an insulating substrate 1 supporting a contact stud 2 and a foot 3, on the upper part of which rests the end 4 of a beam 5 whose distal part 6 is disposed above contact stud 2, and separated from the latter by a small free space. The substrate may also comprise two other studs 7 and 8 which can facilitate the connection of the MMC contactor to an electronic circuit. Studs 7 and 8 are respectively connected to stud 2 and to foot 3 by electrically conducting areas 9 and 10, obtained by metallization. As will be seen below, each layer comprises a first layer 9*a* (respectively 10*a*), intended to adhere to substrate 1, and a second layer 9*b* (respectively 10*b*), intended to improve the growth of the electrodeposition. The foot and the beam are obtained by electrodeposition of a conducting material 11, which is preferably selected to ensure a high quality electrical contact. Gold, for example, is used, the height of stud 2 being typically between 5 and 10 μm, and the height from the base of foot 2 to the upper face of beam 5 being between 10 and 25 μm, so that the space separating distal end 6 of the beam and stud 2 is substantially between 2 and 5 μm. The beam is obtained by electrodeposition of a ferromagnetic material 14 having a low hysteresis, such as a iron-nickel alloy in a proportion of 20/80 respectively, said electrodeposition being possibly preceded by the electrodeposition of a smaller layer 13, intended to improve the contact, such as a layer of gold. As appears more clearly in FIG. 2, this beam has a substantially rectangular section of a thickness between 3 and 10 μm, of a width between 5 and 20 μm and of a length between 300 and 600 μm, so that it possesses sufficient flexibility to come into contact with stud 2 when it is attracted by a magnet 16.

According to a technique which is known in itself, the MMC contactor is not produced individually, but in lots or batches on a same substrate, each contactor then being able to be cut out. Likewise, before the cutting out operation, its is possible, even desirable, to fix a protective hood above each contactor, for example by gluing.

Figure 3:
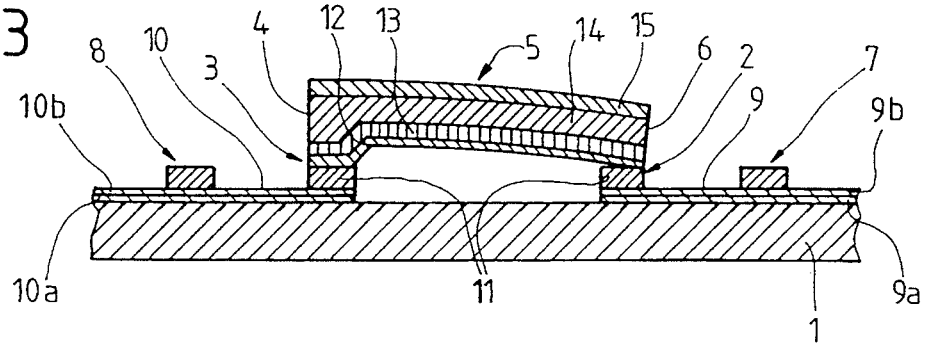
FIG. 3 is a side view in cross-section of a MMC contactor according to a second embodiment of the invention.
Figure 4:
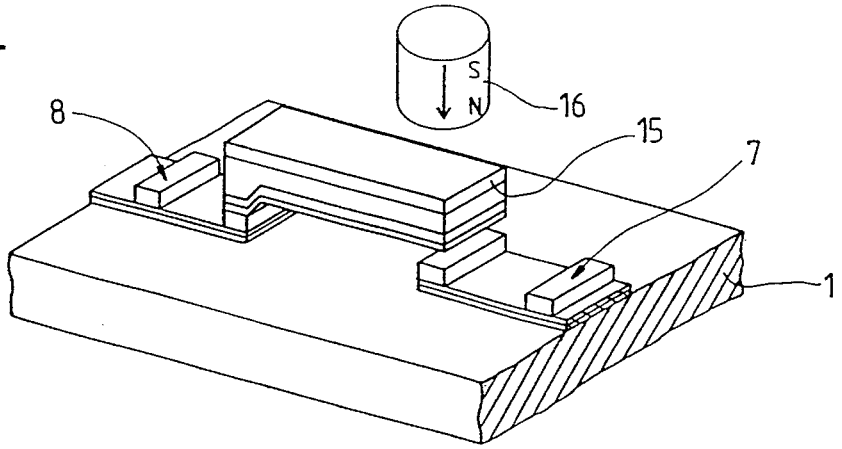
FIG. 4 is a simplified perspective view of the MMC contactor according to the second embodiment, when it is activated by a magnet.

FIGS. 3 and 4 show a second embodiment of a MMC contactor according to the invention. By comparing FIGS. 1 and 3, one observes that beam 5 comprises an additional layer of electrodeposition 15. This deposition is achieved with a conducting material, with or without ferromagnetic properties, and having by electrodeposition, compressive properties. In the present case, a electrodeposition of chromium has been carried out, of a thickness between 1 and 5 μm. As is seen in FIG. 3, at the end of the manufacturing method which will be explained in more detail below, the electrodeposition of chromium creates a constraint which, in the absence of any magnetic field, will bend the beam and maintain the contact between stud 2 and distal end 6. FIG. 4 shows in perspective the MMC contactor of FIG. 3 in its open position when a magnet 16 approaches.

Referring now to FIGS. 5 to 13, an embodiment example of the method which enables a MMC contactor according to the invention to be obtained from an insulating substrate 1 will be described in more detail. This substrate may be a natural insulator such as glass or ceramic or made into an insulator by a treatment beforehand.

Thus, when a silicon wafer is used because of the advantages which it offers for production in batches, an oxidation is carried out beforehand in an oven in the presence of oxygen so as to create a quasi monomolecular silicon dioxide insulating film.

Figure 5:
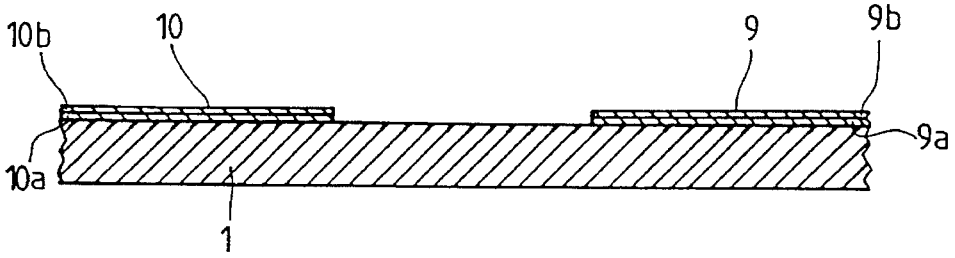
FIGS. 5 to 13 are side views in cross-section of the various manufacturing steps of a MMC contactor shown in FIGS. 1 or 3.

In a first step, shown in FIG. 5, insulated conducting areas 9, 10 are achieved by etching, in accordance with a conventional technique, a metallization carried out on substrate 1 by vapor deposition of a gripping metal, then a metal intended to improve the efficacity of the electrodeposition. The first layer 9*a*, 10*a* is for example formed by 50 nm of titanium and the second by 200 nm of gold.

Figure 6:
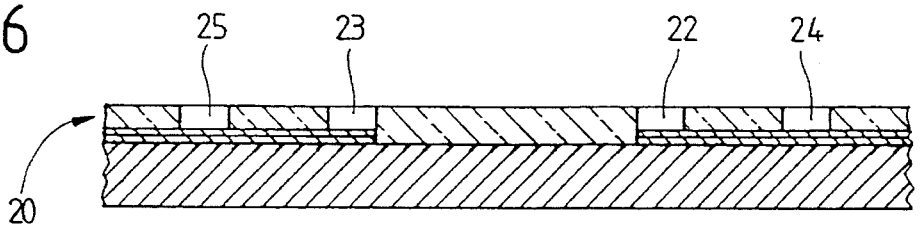

In the second step, illustrated by FIG. 6, one deposits over the entire surface of conducting areas 9, 10 and substrate 1 which separates them, a first photoresist layer 20, in a thickness of between 5 and 10 μm. This layer is then configured in accordance with usual techniques to obtain two windows 22, 23 above the conducting areas 9, 10 and close to their facing edges, as well as two other windows 24, 25 above the conducting areas, and in alignment with the first two windows. By following the instructions for use formulated by the photoresist manufacturer, one obtains windows having a strong aspect ratio, that is to say with substantially vertical walls.

Figure 7:
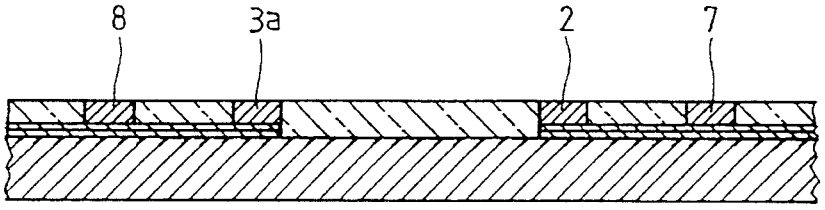

In the following step shown in FIG. 7, a electrodeposition of a metal is carried out in windows 22, 23, 24, 25, until the metal is flush with the photoresist surface. In order to achieve this electrodeposition, a metal which is not very prone to corrosion and capable of ensuring a good electrical contact, such as gold, is preferably used. One thus obtains four studs, stud 3*a* forming the base of foot 3, stud 2 being the contact stud of the MMC contactor and studs 7, 8 being the connecting studs to an external electronic circuit.

Figure 8:
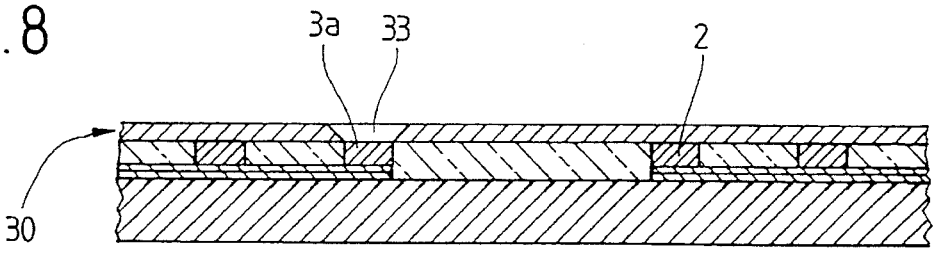

In the fourth step illustrated by FIG. 8, one forms a second mask by depositing a new layer of photoresist 30 and a configuration is carried out over its entire thickness to obtain a single window 33 above stud 3*a*. Unlike the preceding step, by moving away from the optimum conditions recommended for the photoresist used, one obtains window 33 with a low aspect ratio, that is to say with tapered walls. The thickness of the photoresist layer deposited in this step is also used to create an insulating space between 2 and 5 μm, between contact stud 2 and distal end 6 of beam 5 which will be obtained in the following steps.

Figure 9:
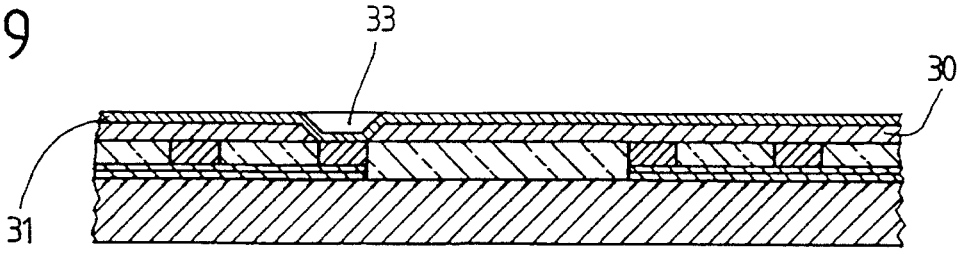

The fifth step, as shown in FIG. 9, consists of depositing by vapor deposition a thin layer of metal over the whole surface of photoresist 30 and the walls and the bottom of window 33. The metal used is preferably gold, and this layer of intermediate metallization is used as a conductor for the following electrodeposition steps.

Figure 10:
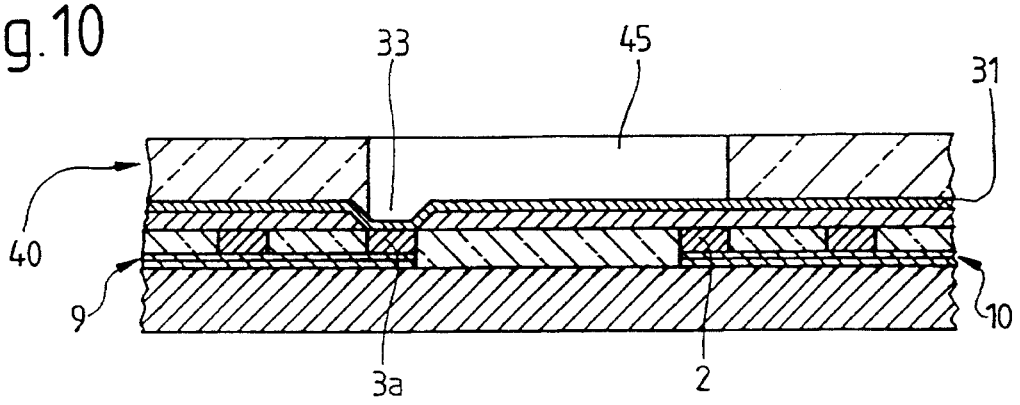

In the sixth step, illustrated by FIG. 10, a third thick photoresist mask 40 is formed and a configuration is carried out over its entire thickness so as to obtain a channel 45 extending between the farthest edges of studs 2, 3*a* disposed on the edges facing conducting areas 9, 10. This configuration thus only leaves apparent metallization portion 31, which will be disposed below beam 5 and in window 33 which will be used for the construction of the second part of foot 3.

Figure 11:
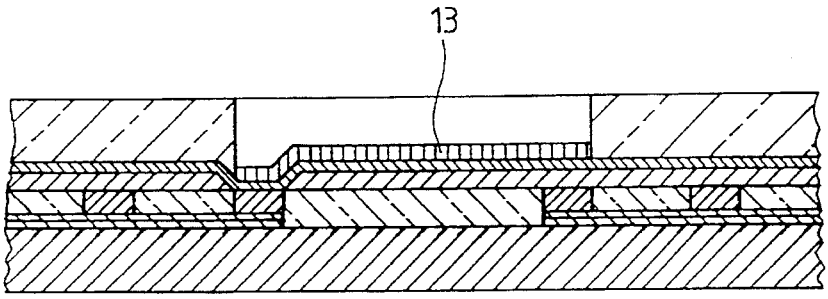
Figure 12:
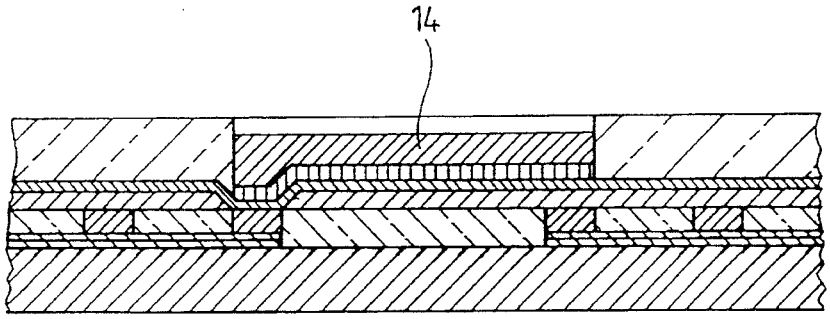

FIGS. 11 and 12 show the growth steps of beam 5, consisting of a first fairly small electrodeposition of gold 13 for improving the electrical contact, then of a depositing a thickness between 3 and 10 μm of a ferromagnetic material which constitutes the active material of beam 5. The ferromagnetic material used in this example is a iron-nickel alloy in a proportion of 20/80 respectively.

Once this stage of the method is reached, masks 20, 30, 40 which have been used to direct the electrodeposition and layer of intermediate metallization 31 are removed in a single operation or in several steps, to obtain a MMC contactor of the type shown in FIG. 1. When this removal is carried out in one step, a chemical agent which dissolves the photoresist, such as an acetone based product, is used simultaneously with mechanical means which break the very thin film, such as by means of ultrasonic waves. When this removal is carried out in several steps, chemical agents capable of dissolving respectively the photoresist and the intermediate metallization layer are used in succession.

Figure 13:
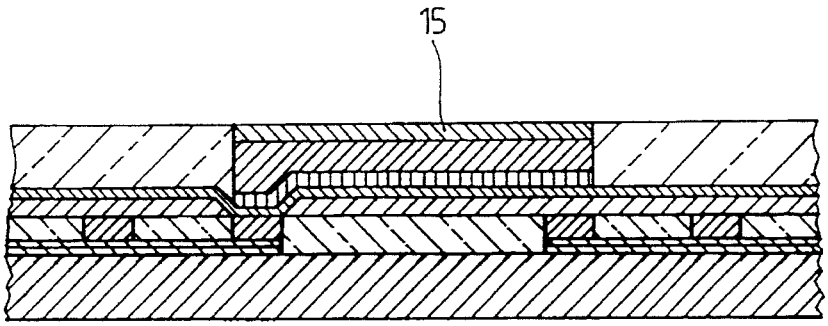

In order to obtain a MMC contactor of the type shown in FIG. 3, an additional electrodeposition step 15 is carried out, as shown in FIG. 13, by using a metal having compressive properties, such as chromium when it is deposited by electrodeposition. After removing of the masks and the intermediate metallization layer as indicated previously, beam 5 is bent which puts it into contact with stud 2.

The method which has just been described is capable of numerous modifications within the reach of the one skilled in the art, as regards to the choice of materials, as well as the dimensions desired for the MMC contactor, within the range of tens of microns.

What is claimed is:

1. Method of manufacturing a magnetic microcontactor comprising a flexible beam in one or more conducting materials, having one end attached to an insulating substrate via the intermediary of a foot, and a free distal end disposed above a contact stud arranged on said substrate, said feet and stud being composed of conducting materials and provided with connecting means to an external electronic circuit, and said beam being at least partly composed of a ferromagnetic material activated by a magnet enabling distal end to move towards or away from the contact stud to establish or to break an electrical contact, consisting in the successive steps of:

a) forming two separate conducting areas each comprising a gripping metallization layer and a layer of a non oxidizable metal on the substrate;

b) forming a first mask by depositing a layer of photoresist and configuring the latter, so as to form at least two windows disposed above a conducting area in the vicinity of their facing edges, said windows having substantially vertical walls;

c) growing by electrodeposition, inside the windows, a conducting material in order to obtain studs until said material is flush with the photoresist surface;

d) forming a second mask by depositing a layer of photoresist and configuring, over its entire thickness, a window above a single stud, said window having tapered walls;

e) depositing an intermediate metallization layer over the whole surface of the photoresist, walls and the bottom of the window formed in step d);

f) forming a third mask by depositing a thick layer of photoresist and configuring, over its entire thickness, a channel extending between the farthest edges of the studs disposed on the edges facing the conducting areas;

g) growing by electrodeposition a ferromagnetic material, to form the beam;

h) growing by electrodeposition a compressive material;

i) removing, in one or more steps, the photoresist layers and the intermediate metallization layer either chemically and mechanically, or solely chemically.

2. Method of manufacturing a magnetic microcontactor according to claim 1, wherein the ferromagnetic material is a iron-nickel alloy in a proportion of 20/80 respectively.

3. Method of making a magnetic microcontactor according to claim 1, wherein the compressive material is chromium.

4. Method of making a magnetic contactor according to claim 1 wherein step (g) is preceded by the electrodeposition of a small thickness of a non magnetic material to improve the contact.

5. Method of making a magnetic microcontactor according to claim 4, wherein the material to improve the contact is gold.

6. Magnetic microcontactor obtained by carrying out steps a) to g) and i) of the method according to claim 1, wherein, in the absence of a magnetic field, a free space exists between the distal end of the beam and the contact stud after removal of the masks by step i).

7. Magnetic microcontactor obtained by carrying out steps a) to i) of the method according to claim 1, wherein, in the absence of a magnetic field, the distal end of the beam is in contact with the contact stud after removal of the masks by step i).

* * * * *